United States Patent [19]

Seiderman

[11] 4,056,075

[45] Nov. 1, 1977

[54] AUTOMATIC HOT MELT ADHESIVE DEPOSITING MACHINE

[76] Inventor: Abe Seiderman, 7365 SW. 132 St., Miami, Fla. 33156

[21] Appl. No.: 648,141

[22] Filed: Jan. 12, 1976

[51] Int. Cl.[2] ..... B05C 5/00

[52] U.S. Cl. ..... 118/7; 118/321

[58] Field of Search ..... 118/321, 8, 6, 7, 232, 118/409, 320; 74/125.5

[56] References Cited

U.S. PATENT DOCUMENTS

| | | | |
|---|---|---|---|
| 1,828,855 | 10/1931 | Bourn | 118/232 X |
| 2,376,980 | 5/1945 | Peterson et al. | 118/322 X |
| 3,324,625 | 6/1967 | Dulmage | 118/321 X |
| 3,342,158 | 9/1967 | Bennett et al. | 118/321 X |
| 3,390,660 | 7/1968 | McDermott | 118/321 X |

*Primary Examiner*—John P. McIntosh

*Attorney, Agent, or Firm*—Ernest H. Schmidt

[57] ABSTRACT

Apparatus for automatically controlling the deposition of hot glue or the like dispensed from the nozzle of a hot melt dispensing machine along a circuitous path upon an upper surface of a work-piece preparatory to its gluing assembly to a complemental member, including a work table for support of a work-piece on which the glue is to be deposited, manually controlled mechanism for initiating a rotative cycle of operation of the work table, mechanism for supporting the nozzle of the glue dispensing machine above a work-piece supported on the work table, a cam rotable in unison with the work support table, and a cam follower on the nozzle support mechanism and operative to move the glue nozzle in a horizontal, rectilinear path over the work-piece for depositing the glue along a circuitous path required of the work-piece as controlled by the cam.

9 Claims, 7 Drawing Figures

AUTOMATIC HOT MELT ADHESIVE DEPOSITING MACHINE

This invention relates to the face-to-face assembly of complementary work-pieces by the use of hot melt adhesive or glue and is directed particulary to apparatus for automatically controlling the deposition of hot glue or the like dispensed from the nozzle of a glue dispensing machine along a circuitous path upon a surface of one of the work-pieces preparatory to its hot gluing assembly to its complemental work-piece.

Heretofore, in the use of hot glue dispensers for applying glue to parts or work-pieces to be assembled by gluing together, the hot glue was applied by manually moving the dispensing nozzle of a so-called glue gum over surface areas upon which the glue was to be deposited for such gluing. The principal object of this invention is to provide apparatus for supporting and automatically controlling the positional relation of the dispensing nozzle of a hot glue machine with respect to a work-piece being rotated through a cycle of operation below the glue dispensing nozzle so that the path of glue deposited lies along a pre-determined path for proper gluing assembly to its complemental part or work-piece.

A more particular object is to provide an automatic hot melt adhesive depositing machine of the above nature including a rotatable work support table having means for positionally locating a work-piece thereon and cam means rotatable in unison with the work support table and operative to control a support member for the dispensing nozzle as the work support table rotates to effect the desired circuitous path of glue deposited on the work-piece as the work support table is rotated through a complete cycle of operation.

Yet another object of the invention is to provide an automatic hot melt adhesive depositing machine of the character described including manually-controlled means for simultaneously initiating a cycle of operation of the work support table and the dispensing of hot glue from the glue dispensing nozzle, and for automatically both stopping the rotation of the work support table and the dispensing of the glue from the dispensing nozzle upon the completion of one full cycle of rotation of the work support table.

Still another object of the invention is to provide an automatic hot melt adhesive depositing machine of the above nature which can readily be adjusted to accommodate work-pieces of a wide variety of peripheral shapes for depositing hot glue thereon along any particular circuitous path required for proper gluing.

Other features, objects and advantages of the invention will be apparent from the following description when read with reference to the accompanying drawings. In the drawings, wherein like reference numerals denote corresponding parts throughout the several views.

Figure 1:
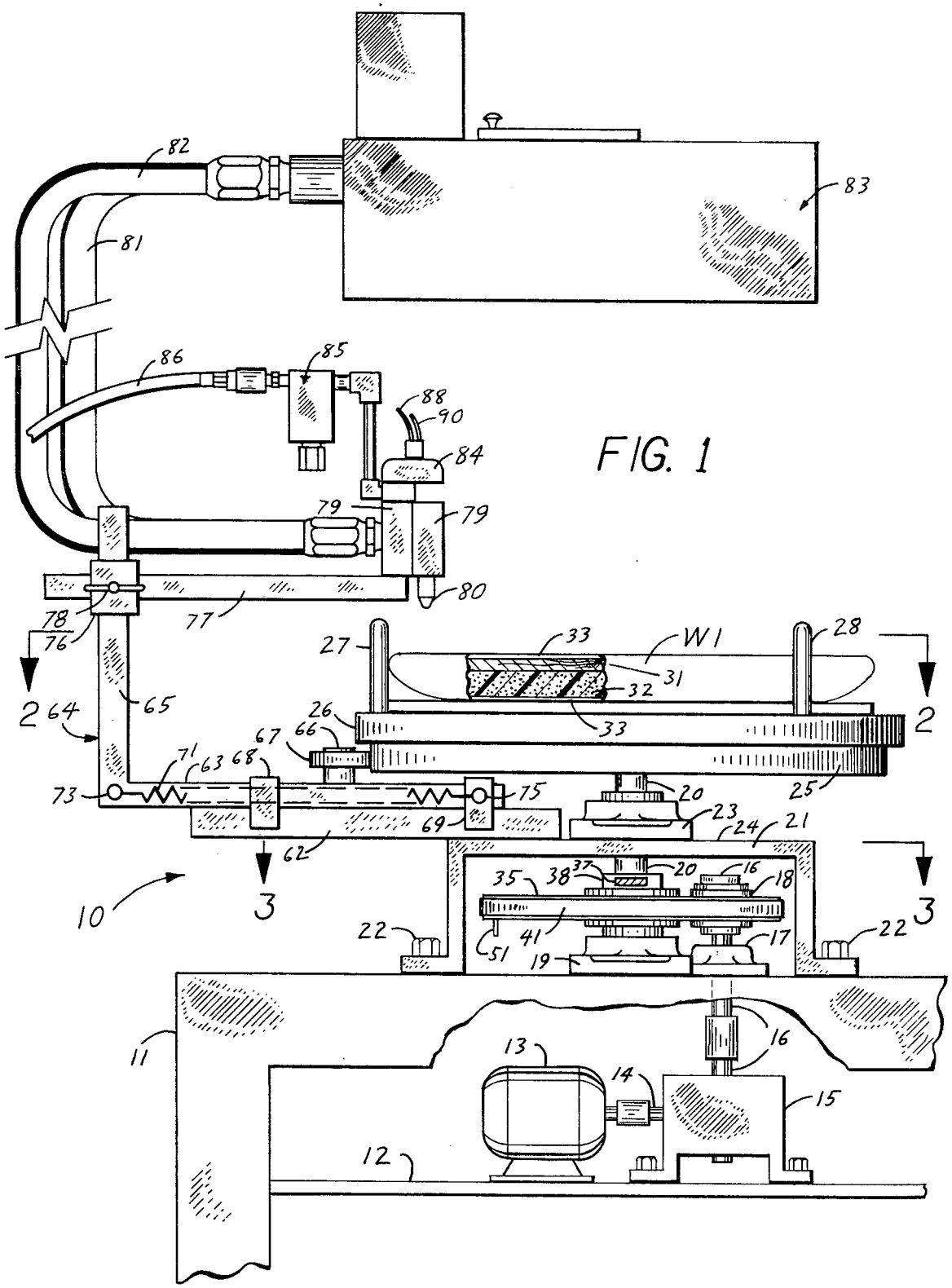
FIG. 1 illustrates, in side elevational, a preferred form of hot melt adhesive depositing machine embodying the invention.

Referring now in detail to the drawings, reference numeral 10 in FIG. 1 designates, generally, an automatic hot melt adhesive depositing machine embodying the invention shown fitted thereon for the automatic deposit of hot melt glue, a work-piece W1 being prepared for gluing assembly in face-to-face relation to a second work-piece W2, (illustrated only in FIG. 7), as herein below more particularly described.

The automatic hot melt adhesive depositing machine 10 comprises a support table 11, preferably fabricated of metal, below the top surface of which is mounted, on support shelf 12, an electric drive motor 13. The drive motor 13 is coupled to the input shaft 14 of a gear reduction box 15, also secured to the shelf 12, the low speed output shaft 16 of which extends vertically upward through a bearing 17 secured to the top of the table 11. The upper end of the output shaft 16 carries a pulley sheave 18 which rotates continuously during operation of the machine, as herein below more particularly described. The top of the table 11 also has secured thereto a thrust bearing 19 journalling an upwardly-extending work table drive shaft 20. The drive shaft 20 extends through upwardly-offset rectangular bracket 21 affixed against the table top 11 as by mahcine bolts 22, and is journalled in a bearing block 23 secured against the upper flat surface 24 of said bracket.

The upper end of the table drive shaft 20 carries a cam wheel 25, the peripheral shape of which corresponds to the pattern of the ribbon of hot glue to be deposited on a particular work-piece for which the machine is set up, as is hereinafter more particularly described. Secured flat against the cam wheel 25 is a rotary work table 26 extending vertically upwardly of which are a plurality of locating pins 27,28,29,30 appropriately located about said work table to provide guidance in the manual placement upon said work table of the work-piece in properly positioned and centered relation with respect to the cam wheel 25 for symmetrical disposition of the ribbon of hot glue in the manner and for the purpose herein below more particularly described.

Figure 7:
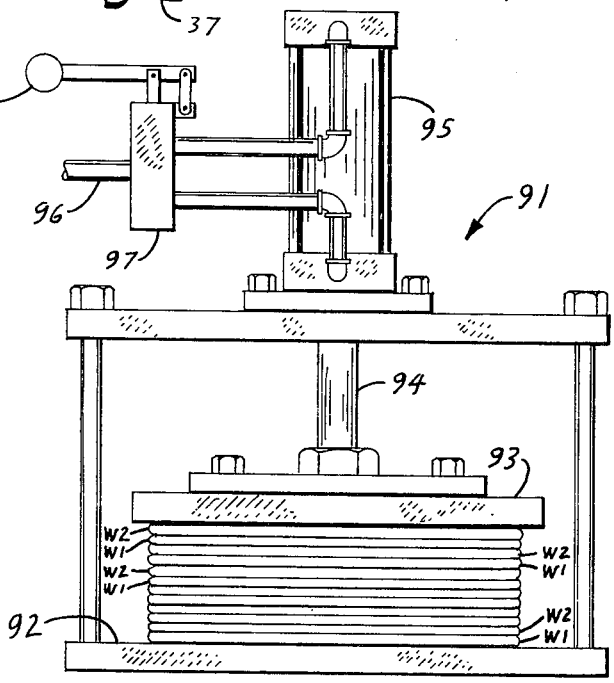
FIG. 7 is a front elevational view of a pneumatic press used for temporarily retaining work-pieces deposited with hot glue assembled to the parts to be glued to until sufficient bonding strength has developed to prevent separation.

In the embodiment of the invention described and illustrated, the work-piece W1 upon which a ribbon of hot glue is to be deposited in a particular pattern is the upper half of a cushioned toilet seat to be subsequently assembled to a lower toilet seat half W2 (FIG. 7). As illustrated in FIG. 1 and 2, the work-piece W1 comprises a hardboard base 31 covered on one side with a layer of cushioning material 32 secured in place by an outer covering of sheet vinyl 33, for example, turned over outside marginal portions of said hardboard base 31 and secured thereat as by a plurality of peripherally-spaced staples 34.

Coaxially secured to the table drive shaft 20 between the underside of the bracket 21 and the top of the table 11 is a comparatively large pulley wheel 35. Pivotally journalled on the table drive shaft 20 above the pulley wheel 35 is a drive control lever 36 having a forwardly projecting control bar 37 and a rearwardly projecting idler pulley arm 38. The idler pulley arm 38 is fitted with a downwardly-extending axle 39 at its outer end journalled upon which is an idler pulley 40. A pulley belt 41 is entrained about the idler pulley 40, and the pulley wheel 35.

Figure 3:
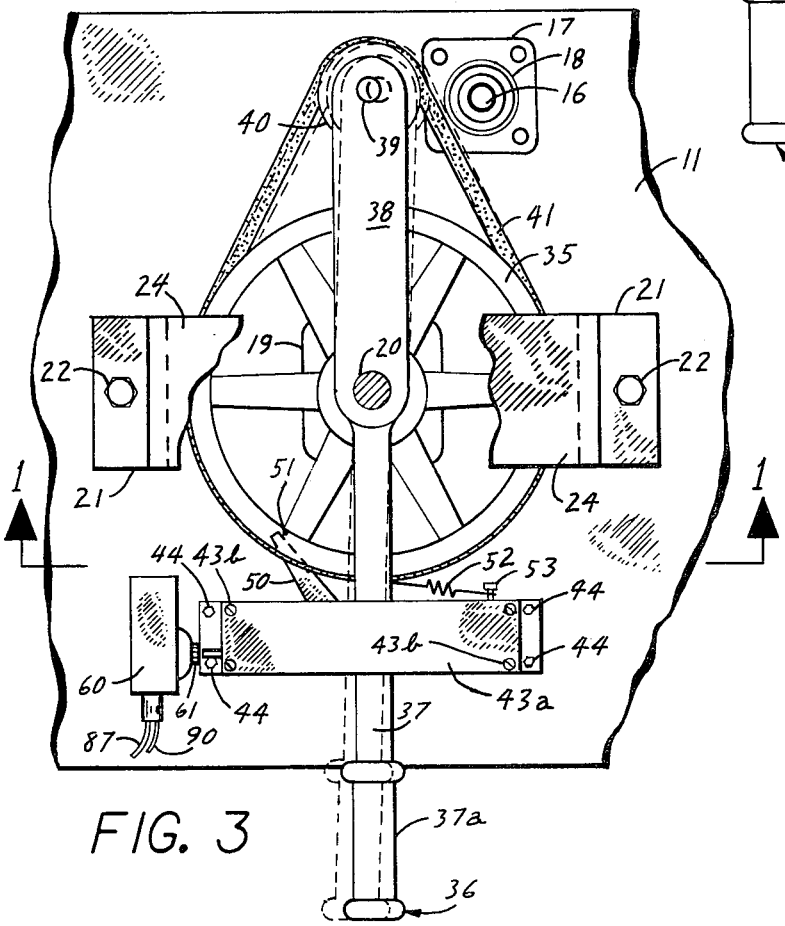
FIG. 3 is a horizontal cross-sectional view taken along the line of 3—3 of FIG. 1 in the direction of the arrows with portions broken away to reveal constructional details.
Figure 5:
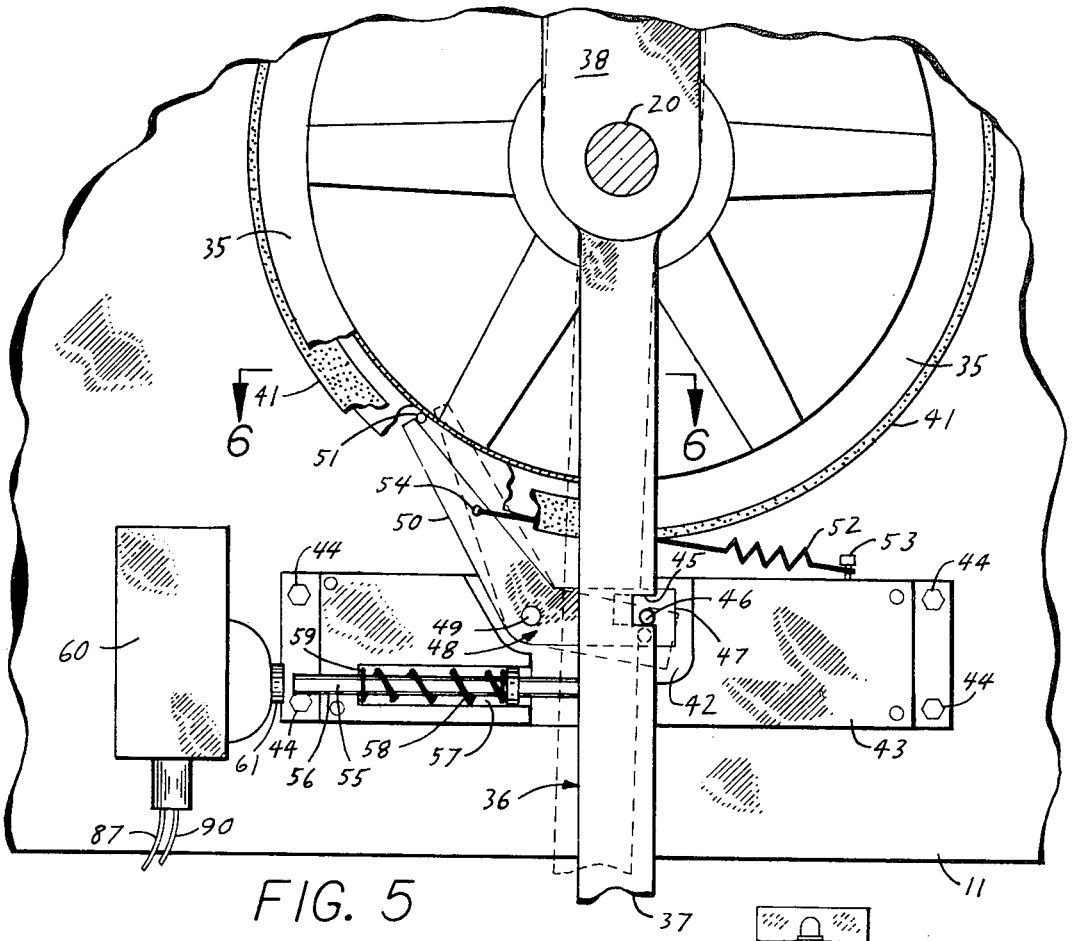
FIG. 5 is a horizontal cross-sectional view similar to that of FIG. 3 but on an enlarged scale and with portions broken away to illustrate operational details.
Figure 6:
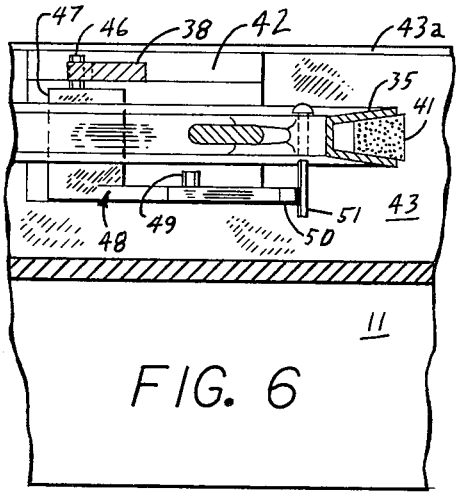
FIG. 6 is a vertical cross-sectional view taken along the line 6—6 of FIG. 5 and further illustrating mechanical details of the operating mechanism.

Means is provided for turning the work table 26 through one complete revolution each time a handle 37*a* at the outer end of the control bar 37 is moved manually to the left, as illustrated in FIG. 3, that is, when said handle is moved from the position illustrated by the full-line representation thereof to the broken-line representation thereof. To this end, as best illustrated in FIG. 5, the control bar 37 extends forwardly through an opening 42 provided in the top of a support block 43 affixed against the top of the table 11 as by machine bolts 44. As illustrated in FIG. 3, the support block opening is fitted with a cover plate 43*a* secured as by machine screws 43*b.*

A rectangular notch 45 formed in one side of the control bar 37 normally receives captured therein the upwardly-extending pin 46 at one end of a control arm 47 comprising an angular lever 48. The lever 48 is pivotally journalled to the support block 43 as by pivot pin 49 and extends into a comparatively long lever trip-arm portion 50 which terminates just below an outer marginal portion of the pulley wheel 35, which pulley wheel has secured thereto, at an outer rim portion thereof, a downwardly-extending trip pin 51. A tension spring 52 secured at one end against the inside of the support block 43 as by locating pin 53 and looped at its other end through an opening 54 midway along the length of the trip-arm portion 50 of the lever 48, constrains said lever to move in the clock-wise direction as depicted in FIG. 5. As further illustrated in FIG. 5, in rest position of the machine, the lever 48 will be urged in its anti-clockwise most position by the pulley wheel trip pin 51 whereat the pin 46 will be captured in the rectangular notch 45 of the manual control lever 35.

Considering now the cyclical operation of the work table 26, it is first to be understood that the electric drive motor 23 will be operating continuously, so that the output shaft pulley sheave 18 is continuously driven. When the operator moves the operating lever handle 37*a* slightly to the left, as illustrated by the broken-line representation thereof in FIG. 3, the idler pulley 40 is moved to the right to carry the pulley belt 41 into driving engagement with the pulley sheave 18, and the pulley wheel 35 will start to move in the clockwise direction as illustrated in FIGS. 3 and 5. Immediately upon such pulley wheel movement, the trip pin 51, will pass beyond the tip of the lever trip arm portion 50 of the angular lever 48, enabling the tension spring 52 to move said angular lever in the clockwise direction, as indicated by the broken-line representation thereof in FIG. 5. In this connection it is to be understood that the above-described movement of the lever arm handle 37*a* to the position represented by the broken-line position thereof in FIG. 5 at the same time moves the lever notch 45 away from the lever pn 46, permitting said pin to slide down against an outer edge portion of the lever bar 42 immediately outwardly of said rectangular notch to retain or lock said lever arm in its operational position for a full cycle of rotation of the work table 26. Upon completion of a full turn of the pulley wheel 35, the trip pin 51 will move the control lever 48 anti-clockwisely to its rest position again, permitting anti-clockwise movement of the drive control lever 36 and disengagement of the pulley belt 41 with respect to the pulley sheave 18, thereby effecting automatic cessation of rotation of the work table 26 to complete the cycle of operation. In this connection it will be noted that a slide rod 55 slidingly arranged in a sidewardly-outwardly-extending bore 56 in the support block 43 abutts against a sidewall portion of the forwardly projecting control bar 37 of the drive control lever 36. The bore 56 opens into an enlarged opening 57 within which is disposed, circumjacent the slide rod 55, a helical compression spring 58 constrained between the annular shoulder 59 at the inner end of the bore 56 and a collar secured on the slide rod 55 near the outer end of the opening 57. The spring-pressed slide rod 55 thus serves to return the drive control lever 36 to its rest position immediately upon the completion of the above described cycle of operation.

The slide rod 55 also serves to close-circuit a normally open single-pole switch 60, fixed with respect to the top of the table 11 and having an actuating push-button 61 in spaced, axial alignment with respect to the outer end of the slide rod 55. Thus, whenever the control bar 37 is in the work table operating position as represented by the broken-line position thereof in FIG. 5, the slide rod 55 will have have been pushed outwardly, i.e. to the left as illustrated in FIG. 5, against the urging of compression spring 58, to depress the push button 61 and thereby close-circuit the electrical switch 60. As herein below described, closure of the electrical switch 60 controls the deposition of hot glue on the work-piece W1 in the desired pattern during each cycle of operation of the machine.

Figure 2:
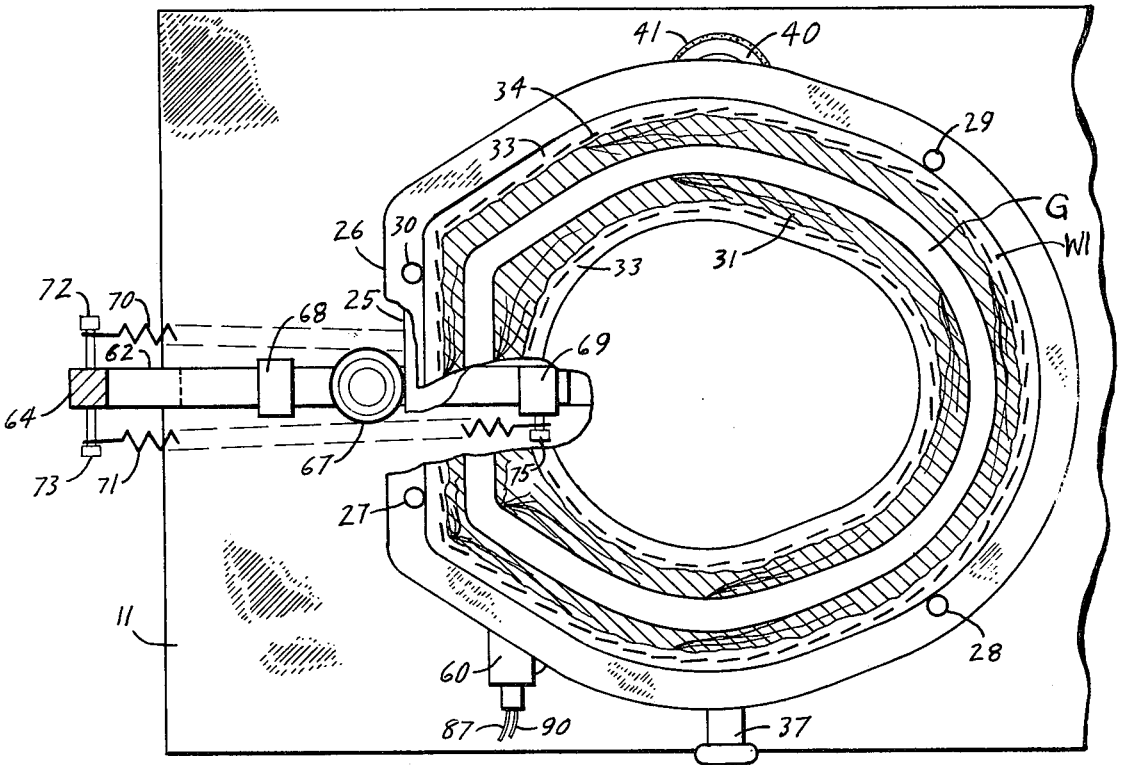
FIG. 2 is a horizontal cross-sectional view of the machine taken along the line 2—2 of FIG. 1 in the direction of the arrows, with portions broken away to illustrate mechanical details and showing a work-piece fitted in place for gluing at the moment of completion of the automatic deposit of hot glue and just prior to its removal for assembly.

As illustrated in FIGS. 1 and 2, the upper surface 24 of the rectangular bracket 21 has secured thereagainst, as by welding, a sidewardly-outwardly-extending slide support bar 62 of uniform rectangular cross-sectional configuration. Slidably disposed atop and along the slide support bar 62 is the horizontal leg 63 of a right-angular slide member 64 comprising an upstanding support leg 65, also of rectangular cross-sectional configuration along its length. The horizontal leg of the slide member 64 is fitted with an upstanding axle 66 rotatively journalled on which is a circular cam follower wheel 67. A pair of U-shaped retainer members 68, 69 overlie inner and outer portions, respectively, of the horizontal leg 63, in straddling relation with respect to sidewall portions of the slide support bar 62 to which they are secured by as welding. The retainer members 68,69 constrain the horizontal leg 63 of the slide member 64 to linear movement along the top of the slide support bar 62. A pair of tension springs 70,71 extending between opposed pins 72,73 secured to opposite sides of the outer end of the horizontal leg 63 of the slide member 64, and opposed pins 75,75 extending outwardly of each side of the inner retainer member 69, (only one illustrated in FIG. 2), serve to yieldingly urge said slide member in the inward direction, whereat the outer periphery of the cam follower wheel 67 is in abutment with the outer peripheral wall of the cam wheel 25.

A sleeve 76 slidable along the vertical support leg 65 of the slide member 64 has secured thereto an inwardly-extending glue nozzle support bar 77. A thumb screw 78 threaded in the sleeve 76 permits vertical positional adjustment of the glue nozzle support bar 77 in accordance with work-piece requirements. A glue dispensing gun member 79 fixed at the outer end of the glue nozzle support bar 77 comprises a downwardly-extending discharge nozzle 80 through which hot glue is dispensed for deposit in the desired pattern about the upper surface of the work-piece W1. The gun member 79 and its discharge nozzle 80 together with electrically-heated feed and return molten glue hoses 81,82, hot melt applicator 83, solenoid control valve member 84 and compressed air regulating and piping mechanism 85 for connection with an air pressure hose 86, comprise a hot melt applicator system operative to continuously circulate molten adhesive through the gun member 79 for application discharge through nozzle 80 whenever the solenoid control valve member 84 is energized. Since such hot melt applicator systems are known, as exemplified, for example, by hot melt applicator model VII Nordson Corporation of Amherst, Ohio, illustrated and described in their technical publication identified as 41-7-1 issued Apr. 21, 1972, and since the hot melt applicator in and of itself is not claimed herein, further description thereof is not deemed to be necessary for a complete understanding of the present invention. Suffice it to say that each time the solenoid control valve member 84 is energized, molten adhesive or glue will be discharged through the nozzle 80.

Figure 4:
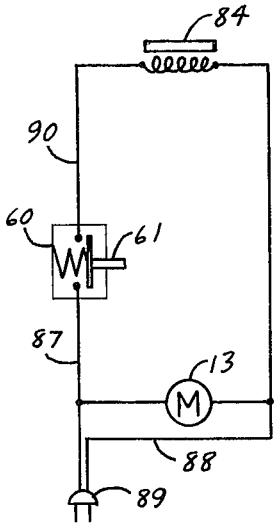
FIG. 4 is an electrical schematic diagram of the electrical control system.

Referring now to the electrical schematic diagram of FIG. 4, it will be seen that the electric drive motor 13 is connected directly across supply line conduits 87,88 which terminate in electrical plug 89 for connection with an ordinary 110 volt a.c. electrical supply receptable. The push button switch 60 and the solenoid control valve member 84 are connected in series across the supply line conduits 87,88 through series conductor 90. Thus, upon plugging in the electrical plug 89, the electric drive motor 13 will become continuously energized, whereas the solenoid control valve member 84 will be energized only during a rotative cycle of operation of the rotary work table 26, said cyclical operation being coincident with actuation of the push button 61 and consequent closure of the solenoid energizing switch 60 as is herein above described. It will thus be understood that during each cycle of operation of the rotary work table 26, a continuous bead of hot glue G will be deposited upon the upper surface of the work-piece W1. Since the glue nozzle support bar 77 carried by the support leg 65 of the slide member 64 will move back and forth during rotation of the rotary work table 26 as controlled by the cam wheel 25, the pattern of the glue bead circuit deposited can readily be made to conform with the particular requirements of the work-piece W1 to be glued. In the example illustrated, the cam wheel 25 conforms in peripheral shape with that of the work-piece W1 so that the hot glue bead circuit follows a path more or less central of the inner and outer peripheral edges of said work-piece, as is readily apparent in FIG. 2. It will be understood, of course, that the rotary work table and its locating pins 27,28,29,30, and the underlying cam wheel 25 can readily be modified to accommodate work-pieces of different shape upon which hot glue is to be deposited along any particular path, as may be required.

FIG. 7 illustrates, by way of example a pneumatic press 91 having a fixed base plate or table 92 and a movable pressure plate 93 secured against the lower end of a vertically-extending piston shaft 94 controlled by a double-acting pneumatic cylinder 95 fixed against the upper end of said press. Compressed air supplied through conduit 96 to a reversing control valve 97 having a manually-actuated control lever 98 supplies compressed air, selectively, to the lower or upper end of the pneumatic cylinder 95 for corresponding raising or lowering the movable pressure plate 93. In operation, upon completion of a cycle of glue deposition upon a work-piece W1 as described above it will be removed from the rotary work table 26, manually assembled to complementary work-piece W2 to which it is to be glued, and placed in stacked relation upon the pressed plate 92, the movable plate 93 first having been withdrawn or raised by actuation of the control lever 98. The control lever will then be actuated to lower the movable pressure plate 93 against the stacked work-piece sets, while the operator proceeds to prepare the next-piece W1 for gluing assembly by the use of the glued deposition machine 10 as herein above described. Since the hot glue solidifies quite rapidly, after a few minutes the work-piece sets W1,W2 can be removed from the press without the possibility of separation of the parts, to complete the gluing assembly operation.

While I have illustrated and described herein only one form in which my invention can conveniently be embodied in practice, it is to be understood that this form is given by way of example only and not in a limiting sense. The invention, in brief, comprises all the embodiments and modifications coming within the scope and spirit of the following claims.

I claim:

1. Apparatus for automatically controlling the gravitational deposition of hot glue or the like dispensed from the nozzle of a dispensing machine and along a circuitous path upon the upper surface of a flat work-piece having an irregular curvilinear peripheral contour preparatory to its gluing assembly to a complemental member, the dispensing machine included electrical means for starting and stopping the dispensing flow of hot glue, comprising, in combination, a work table having a substantially horizontal support surface for seating the work-piece, means for positionally locating a work-piece upon said support surface, means for rotating said work table about a vertical axis, mechanism for supporting the nozzle of a hot glue dispensing machine vertically above a work-piece located on said support table, a cam fixed with respect to said work table and rotatable in unison therewith, a cam follower cooperative with said cam, said nozzle support mechanism comprising means slidably supporting said cam follower for rectilinear movement upon rotation of said cam, means for simultaneously initiating a rotative cycle of said work table and starting the flow of hot glue dispensd from the nozzle of the hot glue dispensing machine, and means controlled by the completion of a rotative cycle of operation of said work table for automatically stopping both the rotation of said work table and the flow of hot glue from said hot glue dispensing nozzle, said cam having the same peripheral contour as that of the work-piece upon which glue is to be deposited, and said work-piece locating means being operative to positionally constrain the work-piece so that its peripheral contour is in rotative registration with respect to the peripheral contour of said cam.

2. Hot glue deposition apparatus as defined in claim 1, wherein said work table rotating means comprises a vertically-extending drive shaft, a pulley wheel carried by said drive shaft, an idler pulley, means journalling said idler pulley for rotation about a vertical axis, a pulley belt entrained between said pulley wheel and said idler pulley, a vertically-extending rotary output shaft, a pulley sheave carried by said output shaft, means for continuously rotating said output shaft, said means for simultaneously initiating said rotative a cycle of said work table comprising means for laterally moving said idler pulley so said said pulley belt is brought into driving engagement with respect to said pulley sheave.

3. Hot glue deposition apparatus as defined in claim 2, wherein said idler pulley moving means comprises a drive control lever journalled on said vertically-extending drive shaft, said drive control lever having a forwardly-projecting control bar and a rearwardly-projecting pulley arm, said idler pulley being vertically journalled on an outer end portion of said pulley arm, and a handle at the outer end of said control bar.

4. Hot glue deposition apparatus as defined in claim 3, wherein said means for initiating the rotative cycle of said work table comprises means controlled by the movement of said handle to lock said control lever in driving position, said means for automatically stopping the rotation of said work table comprising trip means for releasing said lock means.

5. Hot glue deposition apparatus as defined in claim 4, wherein said lock means comprises a notch formed along one side of said forwardly-projecting control bar, an angular lever pivotally supported for rotation in a horizontal plane, said angular lever having a control arm terminating in a vertically-extending pin receivable in said rectangular notch, said angular lever having a control arm end portion terminating in proximity to a peripheral rim portion of said pulley wheel, said peripheral rim portion of said pulley wheel having an axially-outwardly-extending trip pin engageable with said outer end portion of said lever trip arm portion for rotating said angular lever about its pivotal axis so that said lock pin will be moved into said notch each time said trip pin engages said outer end of said lever trip arms portion upon the completion of a cycle of operation of said work table.

6. Hot glue deposition apparatus as defined in claim 5, including resilient means constraining said angular lever to pivotal movement in such direction as to urge said lock pin outwardly of said notch and along an adjacent side portion of said drive control lever upon said drive control lever being moved into driving engagement position at the initiation of a cycle of operation.

7. Hot glue deposition apparatus as defined in claim 6, wherein said means for initiating and stopping the dispensing of hot glue from the dispensing machine comprises a normally open electrical switch, and means controlled by the movement of said drive control lever into work table drive position for close-circuiting said electrical switch.

8. Hot glue deposition apparatus as defined in claim 7, wherein said electrical switch close-circuiting means comprises a slide rod, means constraining said slide rod to axial movement in a horizontal plane, one end of said slide rod being in abutting engagement with a sidewall portion of said control bar, means resiliently constraining said slide rod in said abutting position, said electrical switch having an actuating member normally spaced from the other end of said slide rod and adapted to be engaged thereby and depressed for close-circuiting said electrical switch during the interval when said drive control lever is positioned in work table driving position.

9. Hot glue deposition apparatus as defined in claim 8, wherein said rod constraining means serves to resiliently urge said drive control lever in the drive release position.

* * * * *